United States Patent [19]

Scheurer

[11] Patent Number: 5,011,009

[45] Date of Patent: Apr. 30, 1991

[54] CIGAR STORAGE AND TRANSPORTATION CONTAINER

[75] Inventor: Raymond Scheurer, Schoenenbuch, Switzerland

[73] Assignee: Davidoff of Geneva, Inc., New York, N.Y.

[21] Appl. No.: 231,572

[22] Filed: Aug. 12, 1988

[51] Int. Cl.[5] ..... B65D 85/10

[52] U.S. Cl. ..... 206/270; 220/8; 220/366; 220/367

[58] Field of Search ..... 206/270; 220/8, 366, 220/367, DIG. 27

[56] References Cited

U.S. PATENT DOCUMENTS

| | | | |
|---|---|---|---|
| 450,312 | 4/1891 | Hieatzman . | |
| 793,259 | 6/1905 | Wilson . | |
| 1,137,642 | 4/1915 | Lingner | 206/270 |
| 1,143,463 | 6/1915 | Terwilliger, Jr. . | |
| 1,216,031 | 2/1917 | Wilcox | 206/270 |
| 1,263,189 | 4/1918 | Barker | 206/270 |
| 1,481,325 | 1/1924 | Le Gris . | |
| 2,008,606 | 7/1935 | Braden . | |

FOREIGN PATENT DOCUMENTS 656757 5/1929 France .

*Primary Examiner*—Joseph Man-Fu Moy
*Attorney, Agent, or Firm*—Darby & Darby

[57] ABSTRACT

A cigar storage and transportation container is disclosed which includes inner and outer tubular components which are telescoped one within the other. A sealed container is achieved by closing the tubular members at opposite ends, and the interior of the container may be accessed by pulling the tubular members apart. In its side wall, each tubular member includes an opening, and the openings on the tubular members are positioned so that, upon relative rotation of the tubular members, the openings can be brought into varying degrees of alignment. With the openings fully aligned, communication is provided between the interior and exterior of the container, so that a cigar stored therein may readily be exposed to the regulated environment of a humidor. With the openings fully out of alignment, an effective seal is provided between the interior and exterior of the container, thereby preserving the freshness of the cigar.

3 Claims, 1 Drawing Sheet

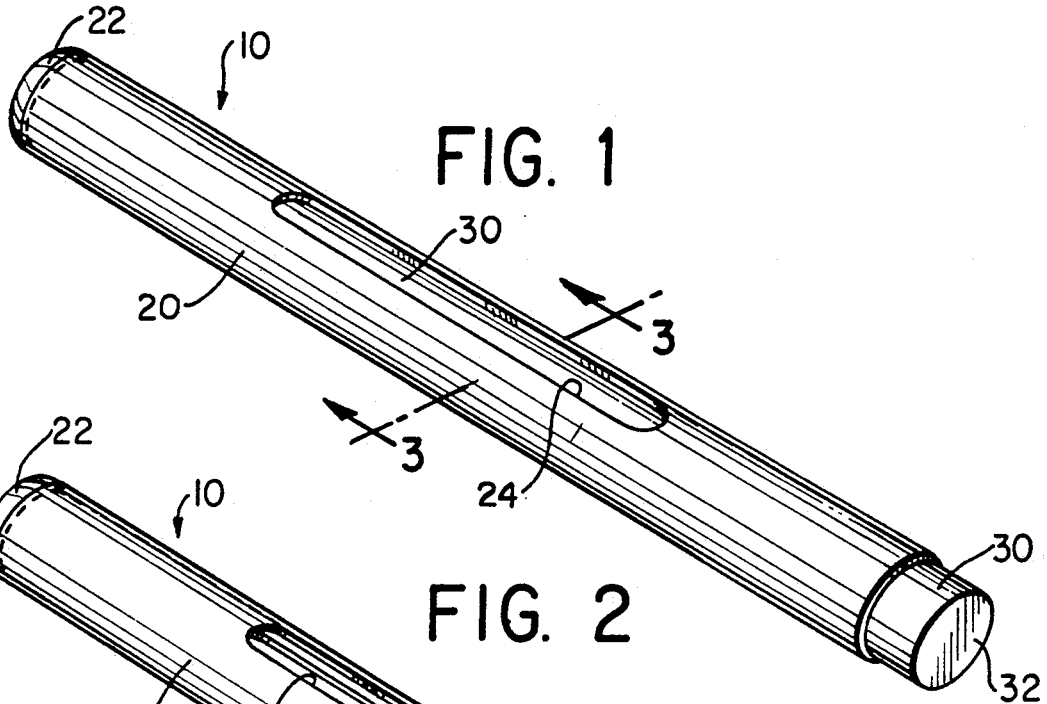
FIG. 1
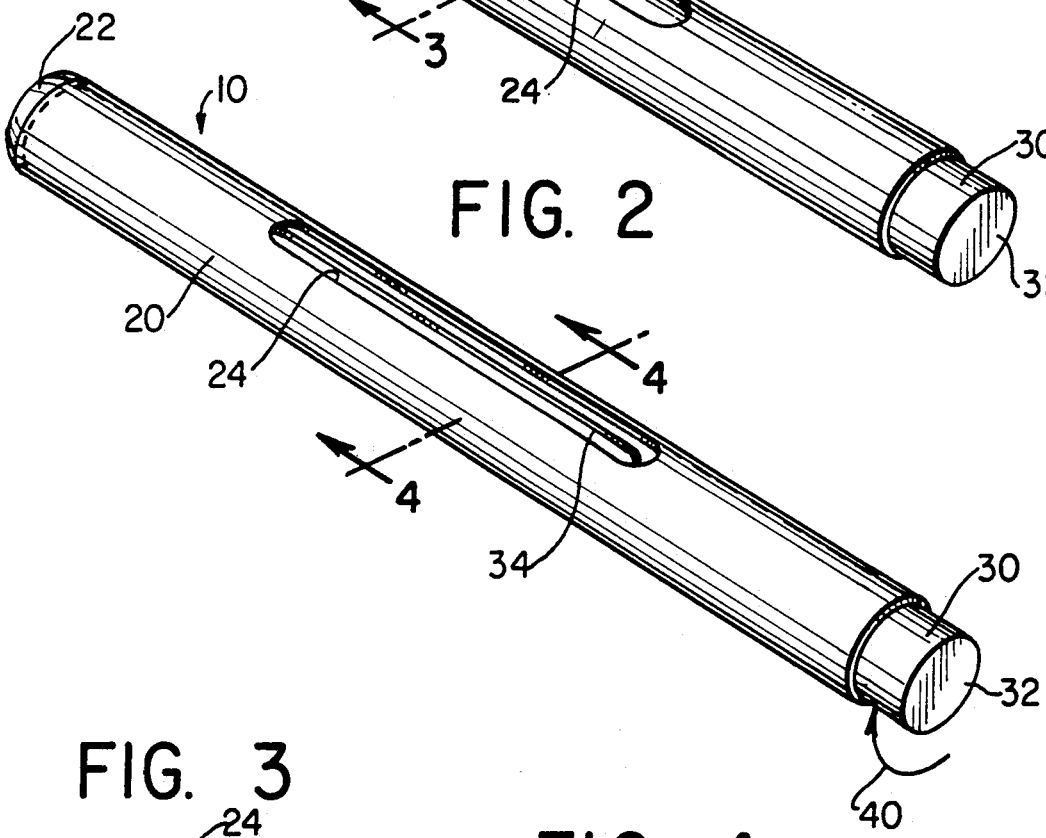
FIG. 2
FIG. 3
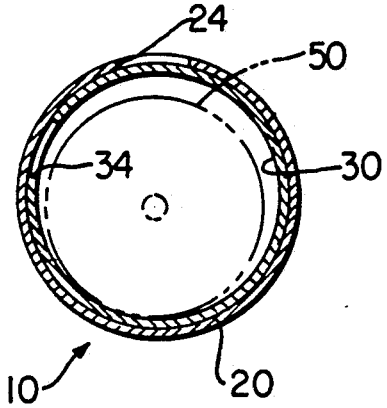
FIG. 4
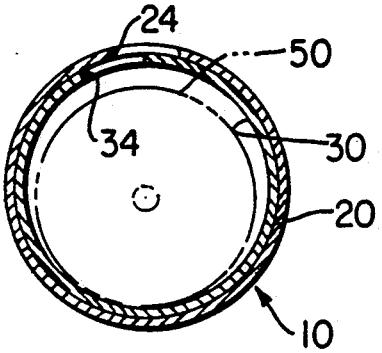

CIGAR STORAGE AND TRANSPORTATION CONTAINER

FIELD OF THE INVENTION

The present invention relates generally to containers for cigars and, more specifically, involves a container which is useful for storing and transporting cigars, while preserving them in their optimum condition of freshness.

BACKGROUND OF THE INVENTION

Fine cigars are made of natural leaf tobacco throughout. Unfortunately, high quality leaf tobaccos are very delicate, and their favor can be preserved, only by maintaining control over the moisture content of the cigar. If the moisture content is too low, the cigar will dry out, burn too rapidly, and will taste hot and unpleasant.

In a tobacco shop, cigars are stored in humidors or special showcases in which the moisture content is controlled. However, once a cigar is removed from the humidor or showcase, it will experience significant moisture loss in a very short time.

In an effort to preserve cigar freshness, manufacturers have sealed them in individual cigar tubes. This, however, proves very expensive and is, at best, a compromise solution. Since it is not normally economical to provide a tightly sealed environment for individual cigars, a certain amount of drying will occur between the time the cigar is stored in its tube and the time it is delivered to the tobacco shop. At the tobacco shop, the cigar could be restored to its optimum condition in a relatively short time by being stored in a humidor. However, the sealed environment of the cigar tube prevents this from taking place, and the cigar must be sold to the ultimate customer in a less than optimum condition.

Ideally, cigars should be sealed at the manufacturers plant in bulk quantities, such as a cigar box full at time. When the sealed box is received by the tobacconist, the seal may be broken, and the entire box of cigars stored in the humidor, to restore the cigars to their optimum condition. Ideally, a cigar need not be placed in a sealed container again until it is removed from the humidor for sale to a customer.

It is therefore an object of the present invention to provide a storage and transporting container for individual cigars which can be placed in an unsealed condition while the cigars are in a humidor, yet may readily be operated to seal the cigar in the container, once it has been removed from the humidor.

It also an object of the present invention to provide a cigar storage and transportation container which is reliable, convenient and efficient in use, yet relatively inexpensive in construction.

In accordance with the present invention, a cigar storage and transporting container comprises inner and outer tubular components which are telescoped one within the other. A sealed container is achieved by closing the tubular members at opposite ends, and the interior of the container may be accessed by pulling the tubular members apart. In its side wall, each tubular member includes an opening, and the opening on the tubular members are positioned so that, upon relative rotation of the tubular members, the openings can be brought into varying degrees of alignment. With the openings fully aligned, communication is provided between the interior and exterior of the container, so that a cigar stored therein may readily be exposed to the regulated environment of the humidor. With the openings fully out of alignment, an effective seal is provided between the interior and exterior of the container, thereby preserving the freshness of the cigar while it is carried about.

BRIEF DESCRIPTION OF THE DRAWINGS

The foregoing brief description, as well as further objects, features on advantages of the present invention will best be understood from the following detailed description of a presently preferred embodiment, with reference being had to the accompanying drawings, in which:

FIG. 1 is a perspective view of a cigar container in accordance with the present invention, with the tubular members shown rotated so that the openings therein are entirely out of alignment, thereby providing a seal between the interior and exterior of the container;

FIG. 2 is a perspective view similar to FIG. 1, showing the tubular members rotated so that the openings are partially aligned to provide some communication and ventilation between the interior and exterior of the container;

FIG. 3 is a sectional view, on an enlarged scale, taken along line 3—3 in FIG. 1 and looking in the direction of arrows; and FIG. 4 is a sectional view, on an enlarged scale, taken along lines 4—4 in FIG. 2 and looking in the direction of the arrows.

DETAILED DESCRIPTION

Referring now to the details of the drawing, there is illustrated a container 10 for storing and transporting a cigar, which container embodies objects and features of the present invention. The container broadly comprises an outer tubular member 20 and an inner tubular member 30 mounted within the outer tubular member in telescoped fashion. One end 22 of the outer tubular member and the opposite end 32 of the inner tubular member are closed, so that a closed container for a cigar is provided when the inner tubular member is mounted within the outer tubular member. The outer and inner tubular members are also provided with elongated openings 24-34 in their side walls, which openings preferably conform substantially in shape and size and are positioned so that they may be brought into varying degrees of overlap by relative rotation between the inner and outer tubular members, as indicated by the arrow 40 in FIG. 2.

In use, a cigar 50 is placed inside inner tubular member 30, and the inner tubular member is then slid into the outer tube as far as it will go. The tubes 20 and 30 may then be rotated relative to each other in order to bring the openings 24, 34 into partial (see e.g. FIGS. 2 and 4) or full (see FIGS. 1 and 3) alignment (or to select intermediate degrees of alignment), whereby selected communication is provided between the interior and the exterior of the container 10. With the tubular members positioned as in FIGS. 2 and 4, the container 10 may be placed within a humidor and the cigar 50 will be exposed to the controlled environment therein. When the container 10 is removed from the humidor, relative rotation of the outer and inner members 30 to bring the openings 24, 34 out of alignment (see FIGS. 1 and 3) will cause the interior of the container 10 to be sealed from the exterior, thereby preventing rapid drying out of the cigar and preserving its freshness.

The inner and outer tubes 20, 30 are preferably made of thin sheet metal, as is common for cigar tubes. Preferably, the inner tubular member 30 has a relatively firm fit within the outer tubular member 20, so that an effective seal may be provided therebetween. Although the openings 24, 34 in the tubular members may be any shape, or more than one opening may be provided in each, it preferable that they be made long and narrow, so as to provide the maximum open area, with minimum weakening of the tubular members.

Although a preferred form of the invention has been disclosed for illustrative purposes, those skilled in the art will appreciate that many additions, modifications, and substitutions are possible without departing from the scope and spirit of the invention as defined in the accompany claims.

What is claimed is:

1. A container for storing a and transporting cigars comprising:

an outer tubular member having a closed end and open end;

an inner tubular member dimensioned to be telescoped within said outer tubular member and having an open end and a closed end opposite the closed end of said outer tubular member, said inner tubular member being slid into said outer tubular member to a redefined stopped position, to define the closed position of said container, the tubular members overlapping over substantially their entire length in the closed position, with a portion of the inner tubular member protruding from the outer one;

said inner and outer tubular members having side openings which conform substantially in size and shape and are positioned so as to be capable of being brought into full alignment by relative rotation of said inner and outer tubular members, said openings being elongated and being smaller in the circumferential direction of said tubular members than the diameter of a cigar, said openings extending along the axes of said inner and outer tubular members for a substantial proportion of their length, the interior of said container being sealed from the exterior thereof when said openings are completely out of alignment, and various degrees of ventilation being provided to the interior of said container, when said openings are brought into various degrees of alignment.

2. A container in accordance to claim 1, wherein said inner and outer containers are made of a thin gauge sheet metal.

3. A method for using a container of the type including an outer tubular member having a closed end and opened end; an inner tubular member dimensioned to be telescoped within said outer tubular member and having an open end and a closed end opposite the closed end of said outer tubular member, said inner tubular member being slid into said outer tubular member to a predefined stopped position, to define the closed position of said container; the tubular members overlapping over substantially their entire length in the closed position, with a portion of the inner tubular member protruding from the outer one; said inner and outer tubular members having side openings which conform substantially in size and shape and are positioned so as to be capable of being brought into full alignment by relative rotation of said inner and outer tubular members, said openings being elongated and being small in the circumferential direction of said tubular members than the diameter of a cigar, said openings extending along the axes of said inner and outer tubular members for a substantial proportion of their length, the interior of said container being sealed from the exterior thereof when said openings are completely out of alignment, and various degrees of ventilation being provided to the interior of said container, when said openings are brought into various degrees of alignment, for optimumally preserving the freshness of a cigar stored therein, said method comprising the steps of:

placing said cigar in said container and bringing the container to its closed position;

rotating said outer and inner tubular members relative to each other so as to provide selected ventilation between the interior and exterior of said container;

placing said container in a humidor providing a controlled environment for storage of said cigars; and upon removing said container from said humidor, rotating said outer and inner tubular members relative to each other so as to bring said openings thereof entirely out of alignment, thereby providing a seal between the interior and exterior of said container, to preserve the freshness of said cigar.

* * * * *